US010130237B2

(12) United States Patent
Innes et al.

(10) Patent No.: US 10,130,237 B2
(45) Date of Patent: Nov. 20, 2018

(54) SYSTEMS FOR STEAM CLEANING

(71) Applicant: SHARKNINJA OPERATING LLC, Newton, MA (US)

(72) Inventors: Dan Innes, Newton Center, ME (US); Lee Cottrell, Newton, MA (US); Paul Grandstrand, Brighton, ME (US)

(73) Assignee: SharkNinja Operating LLC, Needham, MA (US)

( * ) Notice: Subject to any disclaimer, the term of this patent is extended or adjusted under 35 U.S.C. 154(b) by 66 days.

(21) Appl. No.: 15/169,647

(22) Filed: May 31, 2016

(65) Prior Publication Data

US 2016/0374533 A1 Dec. 29, 2016

Related U.S. Application Data

(60) Provisional application No. 62/167,355, filed on May 28, 2015, provisional application No. 62/180,268, filed on Jun. 16, 2015, provisional application No. 62/216,285, filed on Sep. 9, 2015.

(51) Int. Cl.

| | |
|---|---|
| ***A47L 13/22*** | (2006.01) |
| ***A47L 13/12*** | (2006.01) |
| ***A47L 13/254*** | (2006.01) |
| ***A47L 13/26*** | (2006.01) |

(52) U.S. Cl.

CPC ..... *A47L 13/225* (2013.01); *A47L 13/12* (2013.01); *A47L 13/254* (2013.01); *A47L 13/26* (2013.01)

(58) Field of Classification Search

CPC ..... A47L 13/225; A47L 13/12; A47L 13/254; A47L 13/26

See application file for complete search history.

(56) References Cited

U.S. PATENT DOCUMENTS

| | | | | |
|---|---|---|---|---|
| 7,362,064 | B2 | 4/2008 | Coates et al. | |
| 7,380,307 | B2 * | 6/2008 | Tsai | A47L 11/34 15/320 |
| 7,516,565 | B1 * | 4/2009 | Tsen | A47L 13/22 15/321 |
| 8,534,301 | B2 * | 9/2013 | Nottingham | A47L 13/22 134/105 |
| 8,627,543 | B2 | 1/2014 | Vrdoljak et al. | |
| 8,850,654 | B2 * | 10/2014 | Nolan | A47L 13/22 134/105 |

(Continued)

FOREIGN PATENT DOCUMENTS

WO 2015143231 A1 9/2015

OTHER PUBLICATIONS

International Search and Written Opinion dated Mar. 17, 2017 of corresponding International Patent Application No. PCT/US16/35108.

*Primary Examiner* — Dung Van Nguyen
(74) *Attorney, Agent, or Firm* — Grossman Tucker Perreault & Pfleger, PLLC

(57) ABSTRACT

Methods and Apparatuses for steam cleaning comprise a steam cleaning device/system employed for steam cleaning or treating operations. In an embodiment, a steam cleaning device may comprise agitation features employed for steam cleaning or treating. In another embodiment, the steam cleaning device may be a steam accessory employed for steam cleaning or treating. In yet another embodiment, the steam cleaning device may comprise various features employed for multi-purpose steam cleaning or treating.

29 Claims, 14 Drawing Sheets

(56) References Cited

U.S. PATENT DOCUMENTS

| | | | | |
|---|---|---|---|---|
| 9,155,440 | B2 * | 10/2015 | Nuttall | A47L 11/34 |
| 9,585,536 | B2 * | 3/2017 | Pi | A47L 9/16 |
| 2004/0184867 | A1 | 9/2004 | Wang et al. | |
| 2007/0214586 | A1 | 9/2007 | Mattucci et al. | |
| 2010/0043167 | A1 | 2/2010 | Bradbury et al. | |
| 2010/0050367 | A1 | 3/2010 | Tsai | |
| 2010/0251505 | A1 * | 10/2010 | Vrdoljak | A47L 9/0686 15/320 |
| 2012/0269567 | A1 * | 10/2012 | Crawford | A47L 13/12 401/138 |
| 2013/0232719 | A1 | 9/2013 | Luedke et al. | |
| 2014/0208536 | A1 | 7/2014 | Ni | |
| 2014/0245561 | A1 | 9/2014 | Pi et al. | |
| 2014/0259510 | A1 | 9/2014 | Conrad | |
| 2015/0089757 | A1 | 4/2015 | Davidshofer et al. | |

* cited by examiner

SYSTEMS FOR STEAM CLEANING

CROSS REFERENCE TO RELATED PATENT APPLICATIONS

The present application is a non-provisional utility patent application of and claims priority to U.S. Provisional Patent Application Nos. 62/167,355 filed May 28, 2015, entitled "Agitation device for a steam product"; 62/180,268 filed Jun. 16, 2015 entitled "Steam Accessory"; and 62/216,285 filed Sep. 9, 2015 entitled "Multipurpose steam cleaning device," all of which are incorporated herein by reference in their entity. With respect to U.S. Provisional Patent Application No. 62/167,355, since the twelve-month anniversary for filing a non-provisional utility application under 35 U.S.C. 111(b) falls on Saturday, May 28, 2016, this application is timely filed on the succeeding business day, Tuesday, May 31, 2016 (the next business day following U.S. federal holiday, Memorial Day), in accordance with 35 U.S.C. 21.

TECHNICAL FIELD

Aspects described herein generally relate to steam cleaning systems, apparatuses and methods.

BACKGROUND

Surface treatment appliances are used in the home, office and other locations to treat floors and other surfaces. Various types of surface treating appliances, such as steam mops, steamers and portable steam devices are known for cleaning tiles, hard wood and other hard floor surfaces. These surface treating appliances have a variety of features and accessories to enhance the cleaning experience for a user. Often, these appliances are designed to have multiple modes of operation. Sometimes steam cleaning devices include interchangeable attachments that are designed for different types of cleaning needs.

SUMMARY

In the present disclosure, one or more embodiments of steam cleaning apparatuses, methods and systems are described.

In one embodiment, the methods, apparatuses and systems for steam cleaning according to the present disclosure comprises a body comprising a steam generator unit configured to produce steam, a controller in electrical communication with the steam generator unit, a first end, and a second end defining a body outlet configured to output steam generated by the steam produced by the steam generator unit. In such an embodiment, an extension may be attached to the first end of the body, the extension comprising a handle portion and a shaft extending between the handle portion and the first end of the body. Further, a head or cleaning head may be removably attached to the second end of the body, the head comprising a head inlet in fluid communication with the body outlet and configured to direct steam from the body outlet through the head to a target surface to be contacted by a first surface of the head for cleaning. In such an embodiment, the body comprises a scrubber member connected to the second end of the body, wherein attachment of the head to the second end of the body prevents the scrubber member from reaching the cleaning surface, and detachment of the head from the second end of the body permits the scrubber member from reaching the cleaning surface. Further, the controller is configured to operate the steam generator unit in a first mode to produce steam at a first rate that is different from a second steam rate in a second mode.

In a second embodiment the methods, apparatuses and systems for steam cleaning according to the present disclosure comprises a body comprising a body outlet configured to output steam, a scrubber member configured to be oriented in a retracted state or in a deployed state; and an actuation mechanism configured to deploy or retract the scrubber member. In such an embodiment, a head is removably coupled to the body, wherein the head comprises a head inlet in fluid communication with the body outlet; and a head outlet in fluid communication with the head inlet; wherein when the head is coupled to the body, the scrubber member is in a retracted state, the head inlet is configured to receive steam, and the head outlet is configured to output steam outside of the apparatus; and wherein when the head is removed from the body, steam is output outside of the apparatus from the body outlet, and the scrubber member is configured to be in a deployed state by an actuation of the actuation mechanism.

In a third embodiment the methods, apparatuses and systems for steam cleaning according to the present disclosure comprises a body comprising a body outlet configured to output steam. In such an embodiment, a head is coupled to the body, the head comprising a head inlet in fluid communication with the body outlet and a first and second head outlets in fluid communication with the head inlet. The first head outlet is defined through a first portion of the head, the first portion of the head defining a first axis, wherein the first head outlet is configured to discharge steam in a first mode of operation. The second head outlet is defined through a second portion of the head, the second portion of the head defining a second axis, wherein the second head outlet is configured to discharge steam in a second mode of operation; and when the first and second axes intersect at a first angle, steam is discharged in the first mode of operation, and when the first and second axes intersect at a second angle, steam is discharged in the second mode of operation.

In a fourth embodiment the methods, apparatuses and systems for steam cleaning according to the present disclosure comprises a steam generating unit configured to produce steam, a body comprising a first end and a second end, the second end comprising a steam outlet outputting steam, an extension removably attached to the first end of the body, the extension comprising a handle and a shaft extending between the first end of the body and the handle. In such an embodiment, an attachment may be removably attached to the second end of the body, wherein the attachment comprises a steam inlet in fluid communication with the steam out of the body to receive steam. Further, in such an embodiment, a controller is configured to operate the steam generating unit in a first or second steam modes. When the extension is attached to the body, the controller is configured to operate the steam generating unit in the first steam mode to produce steam at a first steam rate of the first steam mode. When the extension is detached from the body, the controller is configured to operate the steam generating unit in the second steam mode to produce steam at a first steam rate of the second steam mode, the first steam rate of the first steam mode and the first steam rate of the second steam mode are different.

In a fifth embodiment the methods, apparatuses and systems for steam cleaning according to the present disclosure comprises a body comprising a first end and a second end, and a steam generating unit connected to the body. In such an embodiment, a first attachment may be operable to be removably coupled to the second end of the body and comprising a steam outlet. Further, in an embodiment, a second attachment may be operable to be removably coupled to the second end and comprising a steam outlet. Even further, in such an embodiment, a controller may be configured to operate the steam generating unit in a first and second steam modes. In the first steam mode, the controller is configured to operate the steam generating unit to produce steam at a first rates whereby a substantially continuous steam flow is delivered through the steam outlet of the first attachment. In the second steam mode, the controller is configured to produce steam at a second rate whereby a substantially continuous steam flow is delivered through the steam outlet of the second attachment, the second rate being different from the first rate.

Other variations, embodiments and features of the present disclosure will become evident from the following detailed description, drawings and claims.

DETAILED DESCRIPTION OF THE DISCLOSURE

It will be appreciated by those of ordinary skill in the art that the embodiments disclosed herein may be embodied in other specific forms without departing from the spirit or essential character thereof. The presently disclosed embodiments are therefore considered in all respects to be illustrative and not restrictive.

Disclosed are steam cleaning apparatuses, systems and methods to provide consumers with enhanced cleaning experience. In one or more embodiments of the present invention, agitation devices are provided for steam cleaning apparatuses to provide consumers with improved stain cleaning. Steam products may include the likes of steam mops, steamers and portable steam devices similar to those described in commonly owned U.S. Pat. No. 8,205,293 granted Jun. 26, 2013 and entitled "Steam Mop," which is hereby incorporated by reference in its entirety for all purposes. In operation, directly blasting floor stains with hot steam may improve the rate at which stains are broken down and thus help speed up the removal/cleaning process. In one embodiment, the steam mop may be de-coupled to separate the body of the steam mop from its head or steam frame. The steam frame may be a steam pocket cleaning head similar to those described in U.S. Pat. No. 7,996,948 granted Aug. 16, 2011 and entitled "Quilted Fabric Towel Steam Pocket for a Steam Appliance," which is hereby incorporated by reference in its entirety for all purposes. Once de-coupled, a user may directly blast floor stains with steam from the main body of the steam mop. In one embodiment, this direct blasting with steam may be used in conjunction with an onboard agitation device to provide an onboard stain cleaning solution. The onboard agitation device may be a scrubber member, which may comprise any device used for scrubbing such as a scrubbing pad or a brush.

In one embodiment, the scrubber member may be actuated via an accessible release button on the rear of the unit. When a user presses the button the scrubbing pad may be deployed to the front of the unit and the steam frame may be de-coupled. When the main unit is removed, the steam frame connector may be presented to the user to ensure re-docking of the main unit. The steam frame connector is not poka-yoke so the main unit may be re-coupled in either orientation. When the main unit is re-docked, the scrubbing pad may automatically retract back to its original position. In the alternative, the steam frame connector may be poka-yoke and may only be coupled in a specific configuration. In some embodiments, the user has the option to attach various pad materials to the scrubber pad. In operation, the scrubbing pad may be articulated to allow a user to use the main unit at a variety of angles.

Figure 1:
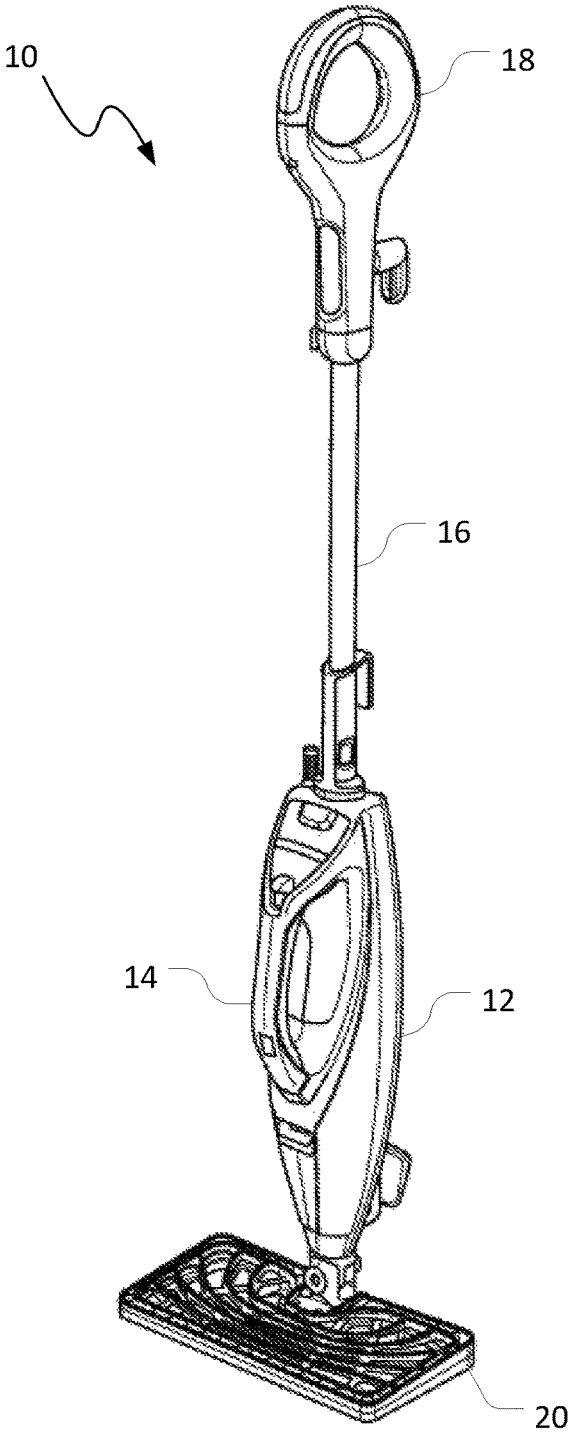
FIG. 1 is a front perspective view of a steam apparatus having an agitation feature according to one embodiment of the present disclosure.

FIG. 1 is a front perspective view of a steam cleaning apparatus 10 having an agitation feature according to one embodiment of the present disclosure. In this embodiment, the steam cleaning apparatus 10 is a steam mop having a body 12 with a first end and a second end. The body 12 comprises a body outlet 24 (best shown in FIGS. 5-6). A steam generator (not shown) may be housed within the body 12 for generating steam to be distributed from the body outlet 24. In an embodiment, the steam generator (not shown) may be an external steam generator connected to the body 12. In one embodiment, a cleaning head 20 may be coupled to the second end of the body 12, the head 20 or the cleaning head 20 may be having a head inlet 26 (best shown in FIG. 4) in fluid communication with the body outlet 24. In this instance, the head or cleaning head 20 may be a steam frame or a steam pocket similar to those discussed above. Although not shown, it will be appreciated by one skilled in the art that the cleaning head 20 may include a head outlet configured to distribute steam. The head outlet may comprise a plurality of openings configured to distribute steam. In other words, steam generated by the steam generator within the body 12 may be delivered from the body outlet 24 to the head inlet 26, and subsequently distributed by the openings in the cleaning head 20 to a cleaning surface for cleaning purposes.

In one embodiment, the first end of the body 12 of the steam cleaning apparatus 10 may be coupled to a pole 16 having a handle 18 for manipulating and maneuvering the steam cleaning apparatus 10. In some instances, the body 12 of the steam cleaning apparatus 10 may be decoupled from the pole 16 and the handle 18, and be manipulated or maneuvered using a grip 14 on the body 12.

Figure 2:
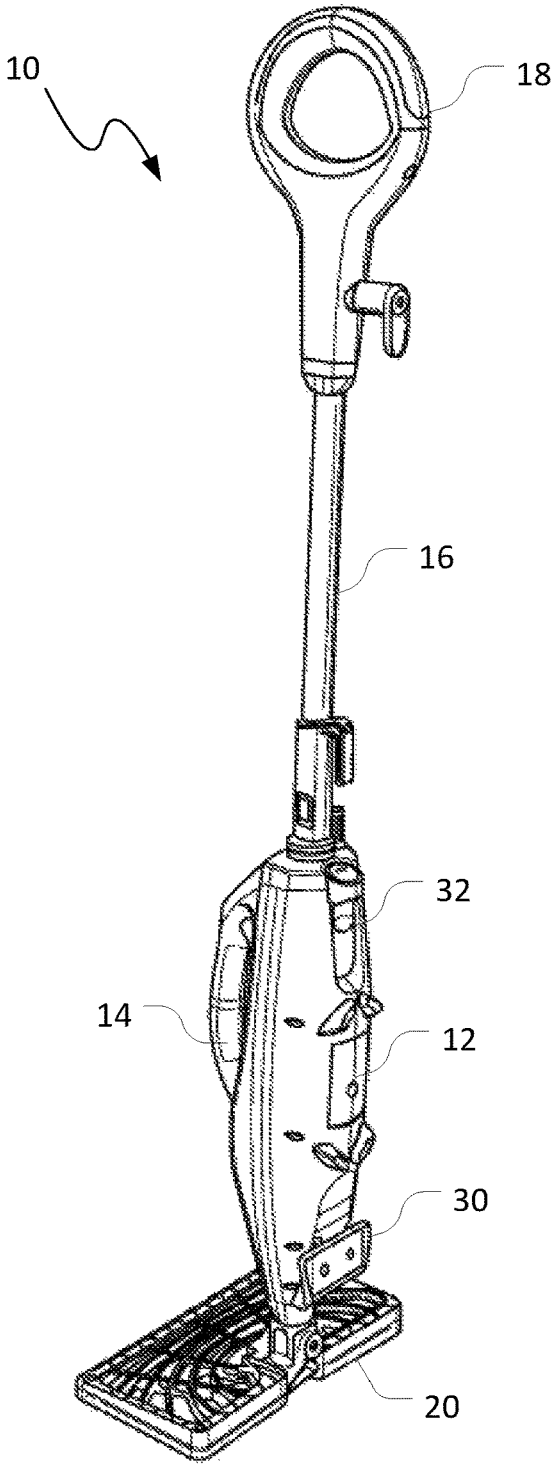
FIG. 2 is a rear perspective view of the steam apparatus of FIG. 1.

FIG. 2 is a rear perspective view of the steam cleaning apparatus 10 of FIG. 1. In this embodiment, the steam cleaning apparatus 10 includes an actuation mechanism 32 in communication with a scrubber member 30 on the body 12 such that actuation of the actuation mechanism 32 causes the scrubber member 30 to extend away from the body 12 and disengage the cleaning head 20 from the body 12. While attachment of the cleaning head 20 to the second end of the body 12 prevents the scrubber member from reaching the cleaning surface, detachment of the head 20 from the second end of the body 12 permits the scrubber member from reaching the cleaning surface. For example, the actuation mechanism 32 may be a button that may be pushed or pulled, while the scrubber member 30 may be an agitation member including the likes of a scrubbing pad. This will become more apparent in subsequent figures and discussion.

Figure 3:
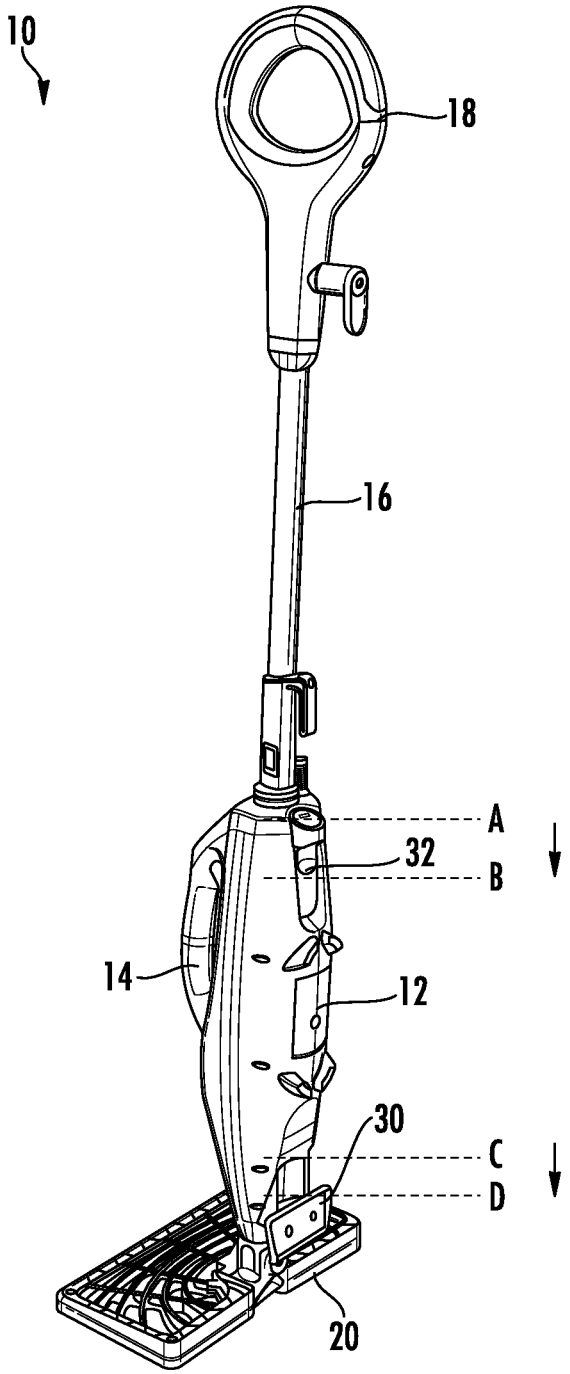
FIG. 3 is a rear perspective of FIG. 2 with the steam apparatus in operation.

FIG. 3 is a rear perspective of FIG. 2 with the steam cleaning apparatus 10 in operation. In this embodiment, the button or actuation mechanism 32 has been actuated or pushed in a downward direction from A to B as indicated by the arrow. Concomitantly, the scrubbing pad or scrubber member 30 is actuated in a substantially similar amount from C to D as indicated by the arrow. In other words, the distance the actuation mechanism 32 is actuated is substantially similar to the distance the scrubber member 30 travels or extends away from the body 12. This may be made possible because the actuation mechanism 32 and the scrubber member 30 are substantially co-axial. In other words, the actuation mechanism 32 and the scrubber member 30 are on a substantially similar axis. In some embodiments, the distance travelled between the actuation mechanism 32 and the scrubber member 30 need not be the same or substantially similar. For example, the button or actuation mechanism 32 in this instance may be an electronic trigger thereby the travel between the actuation mechanism 32 and the scrubber member 30 are different.

Figure 4:
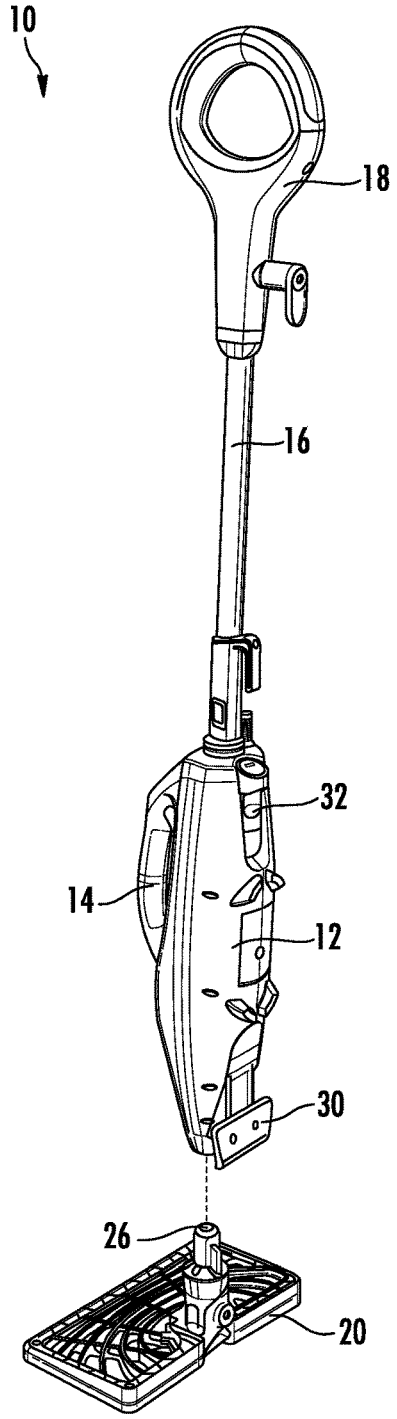
FIG. 4 is a rear perspective view of FIG. 3 after the device has been actuated and the member has been extended.

FIG. 4 is a rear perspective view of FIG. 3 after the actuation mechanism 32 has been actuated and the scrubber member 30 has been extended. Once disengaged, the cleaning head 20 may be decoupled from the body 12 of the steam cleaning apparatus 10 allowing the scrubber member 30 to be used as a scrubbing pad. In one embodiment, the actuation mechanism 32 and the scrubber member 30 are both on the outside of the body 12 while the communication between them is on the inside of the body 12. In this instance, the communication between the actuation mechanism 32 and the scrubber member 30 may be an extension rod contained within the body 12. As discussed above, the actuation mechanism 32 may also be an electrically activated instead of mechanical activation in which case the communication between the actuation mechanism 32 and the scrubber member 30 may be an electrical wire, and the actuation mechanism 32 and the scrubber member 30 need not be co-axial.

Figure 5:
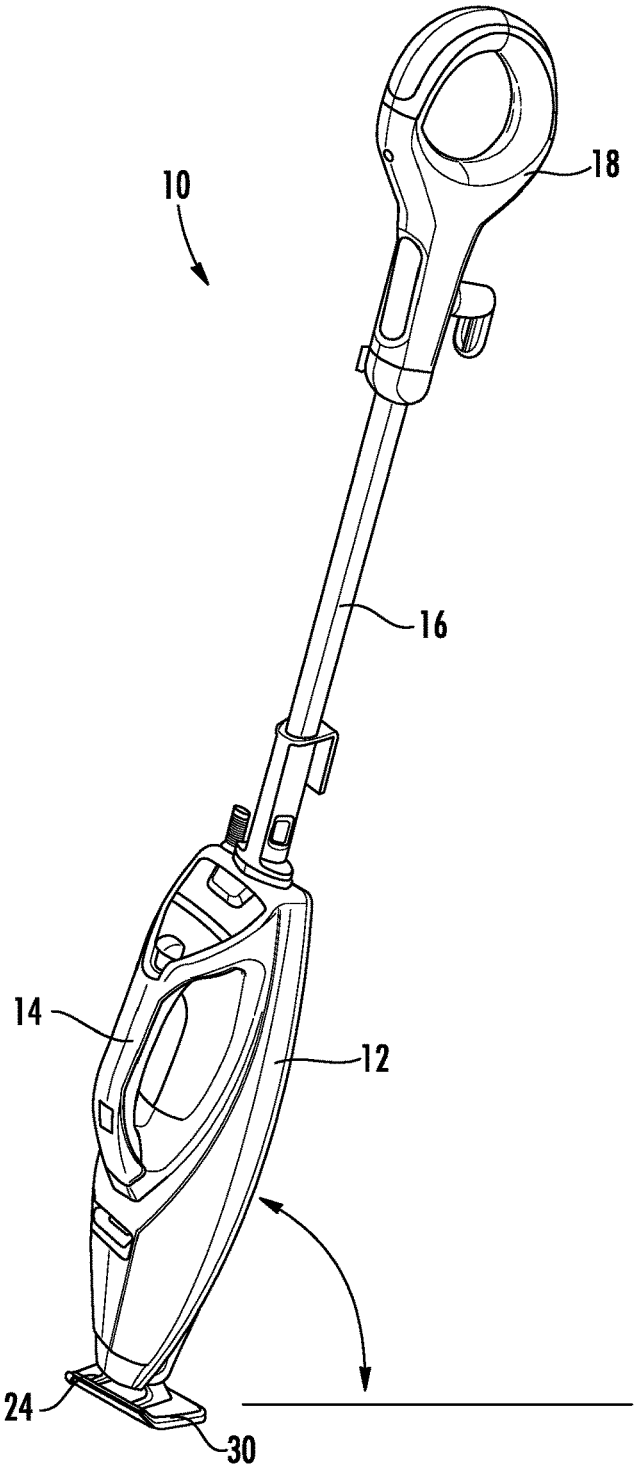
FIGS. 5 and 6 are perspective and side views of the steam apparatus without the cleaning head 20.
Figure 6:
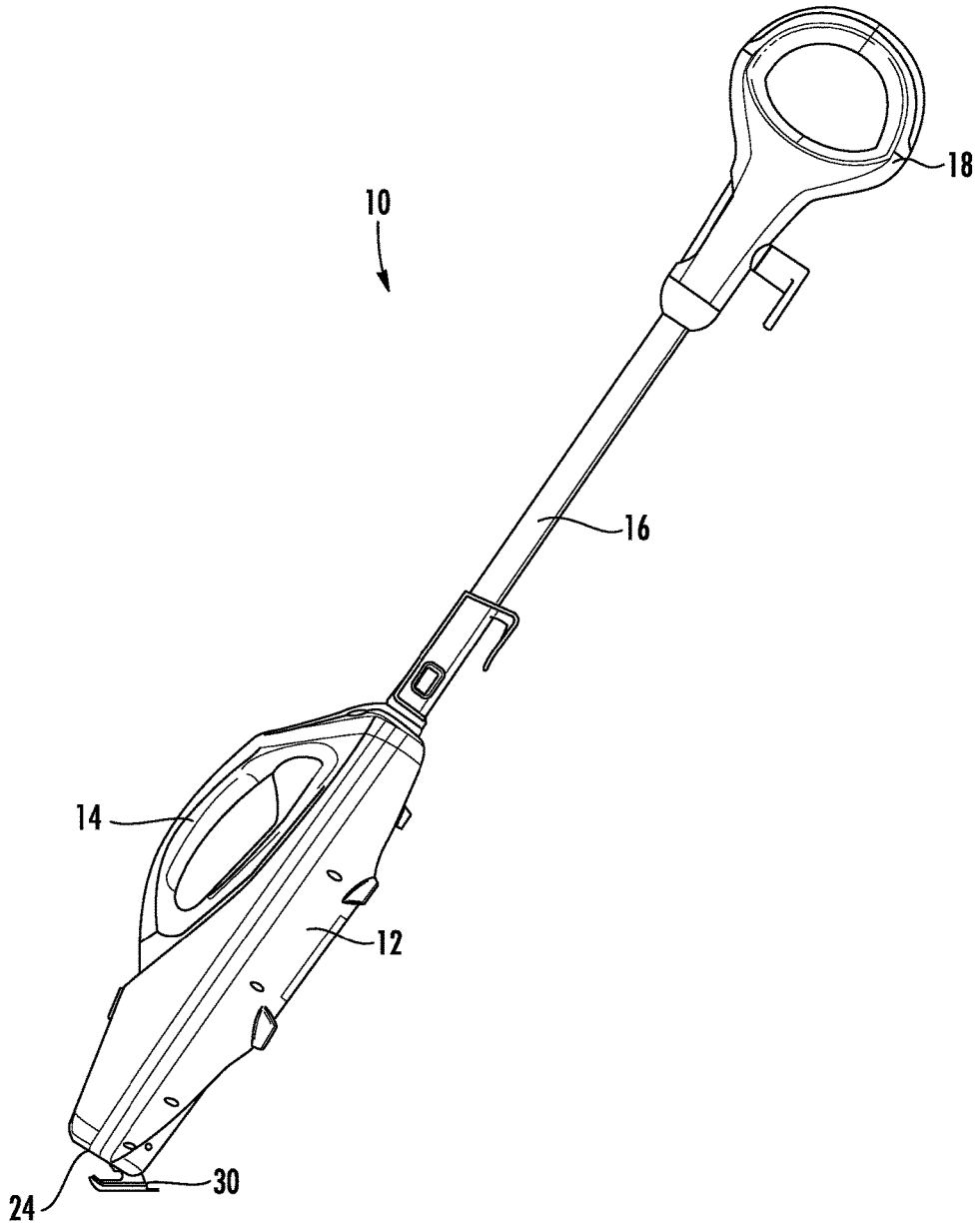

FIGS. 5 and 6 are perspective and side views of the steam cleaning apparatus 10 without the cleaning head 20. As shown, once extended the scrubber member 30 or scrubbing pad 30 may be pivotable relative to the body 12. In other words, the scrubber member 30 may be pivotable relative to the body 12 as the scrubber member 30 extends away from the body 12 and the head 20 is disengaged therefrom. This is best illustrated by the arrows showing the steam cleaning apparatus 10 capable of being used at a variety of angles. In one embodiment, steam may be distributed directly from the body outlet 24 of the body 12 and be used in conjunction with the scrubbing pad 30. In other words, the steam cleaning apparatus 10 in this mode allows the direct distribution or blasting of steam onto a cleaning surface, as the steam exits from the body outlet 24. Once a stain spot on a floor surface has been blasted with steam, the scrubbing pad 30 may be brought into physical contact with the stain spot to be treated to provide the physical agitation necessary to further help remove or clean the stain spot. In some embodiments, the steam cleaning apparatus 10 may further include an attachment (not shown) capable of being coupled to the body outlet 24 of the body 12, the attachment capable of allowing steam to pass there through and be used in conjunction with the scrubber member 30. In this instance, the attachment may be a cloth material or padding material to enhance cleaning. In other embodiments, the attachment may be coupled to the scrubbing pad 30 instead of the body outlet 24. In some embodiments, the attachment may be a hose or other handheld devices similar to those described in the '293 Patent and '948 Patent disclosed and incorporated above.

Figure 7:
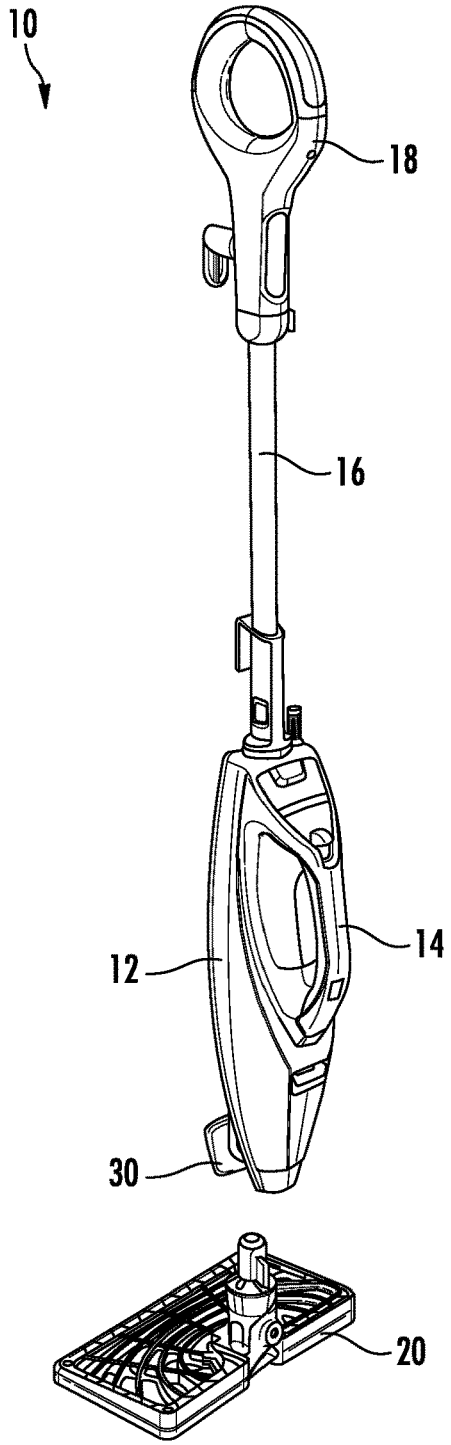
FIG. 7 is a front perspective view of the steam apparatus of FIG. 1.

FIG. 7 is a front perspective view of the steam apparatus of FIG. 1 as the body 12 of the steam cleaning apparatus 10 is being re-inserted or re-docked to the cleaning head 20. As discussed above, the steam cleaning apparatus 10 is not poka-yoke so the body 12 may be re-docked to the cleaning head 20 in either orientation. In this instance, upon re-inserting the body 12 to the cleaning head 20 the reverse of the operational steps discussed above may take place. For example, the scrubber member 30 may be retracted by retracting the actuation mechanism 32. In other words, the scrubber member 30 may be retracted by pulling upward on the push button 32 without having to re-dock the body 12 onto the head 20. In some embodiments, the scrubber member 30 need not be retracted by retracting the actuation mechanism 32 but instead the scrubber member 30 may be automatically retracted as the body 12 is re-mounted onto the cleaning head 20. This may take place as the re-docking of the body 12 onto the cleaning head 20 resets the scrubber member 30 and the associated button or actuation mechanism 32.

In one embodiment, a steam cleaning apparatus 10 includes a body 12 having a body outlet 24, and a head 20 removably coupled to the body 12, the head 20 having a head inlet 26 in fluid communication with the body outlet 24 of the body 12. In this embodiment, the apparatus 10 includes a scrubber member 30 on the body 12 capable of being actuated such that actuation of the scrubber member 30 causes the scrubber member 30 to extend away from the body 12, and disengages the head 20 from the body 12. In this instance, instead of having a button or device for actuating the scrubbing pad, manual actuation of the scrubbing pad may take place using a user's hand or foot.

In one embodiment, the body 12 includes a grip 14 for manipulating the body 12. In the alternative, the body 12 need not have a grip 14. In another embodiment, the head 20 includes a plurality of openings (not shown) configured to distribute steam from the head inlet 26. In some embodiments, the apparatus 10 further includes a handle 18 and a pole 16 coupled to the body 12. In other embodiments, the apparatus 10 further includes a steam generator within the body 12.

In one embodiment, the scrubber member 30 is on the outside of the body 12. In another embodiment, the scrubber member 30 is pivotable relative to the body 12 as the scrubber member 30 extends away from the body 12 and the head 20 is disengaged therefrom. In yet another embodiment, the apparatus 10 further includes an attachment (not shown) capable of being coupled to the body outlet 24, the attachment operable to allow steam to pass therethrough and be used in conjunction with the scrubber member 30.

In one embodiment, a steam system 10 includes a pole 16 having a handle 18 coupled about a first end and a body 12 coupled about a second end, where the body 12 includes a steam generator and an body outlet 24. In this embodiment, a head 20 may be coupled to the body 12, where the head 20 includes an head inlet 26 that is in fluid communication with the body outlet 24, the head 20 having a plurality of openings (not shown) for distributing steam from the head inlet 26. In one embodiment, a actuation mechanism 32 may be in communication with a scrubber member 30 on the body 12 such that actuation of the actuation mechanism 32 causes the scrubber member 30 to extend away from the body 12, and disengages the head 20 from the body 12.

In some embodiments, the distance the actuation mechanism 32 is actuated may be substantially similar to the distance the scrubber member 30 extends away from the body 12. In one embodiment, the actuation mechanism 32 and the scrubber member 30 are both on the outside of the body 12 while the communication between them is on the inside of the body 12, with the actuation mechanism 32 and the scrubber member 30 being substantially co-axial. In another embodiment, the scrubber member 30 is pivotable relative to the body 12 as the scrubber member 30 extends away from the body 12 and the head 20 is disengaged therefrom. In yet another embodiment, the apparatus 10 further includes an attachment (not shown) capable of being coupled to the outlet 26, the attachment operable to allow steam to pass therethrough and be used in conjunction with the scrubber member 30.

Figure 8A:
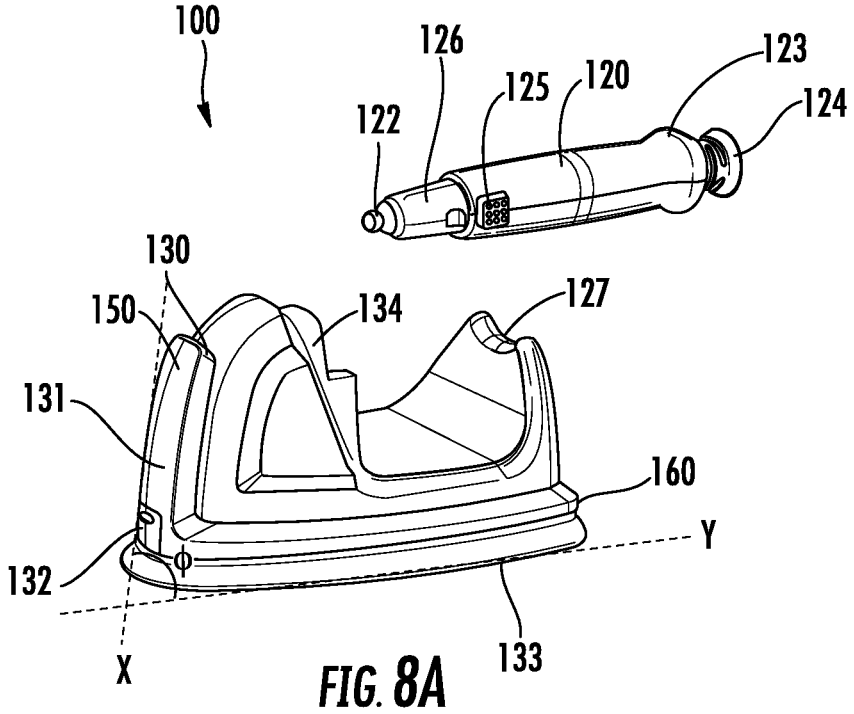
FIGS. 8A-8B show a steam accessory system according to one embodiment.
Figure 8B:
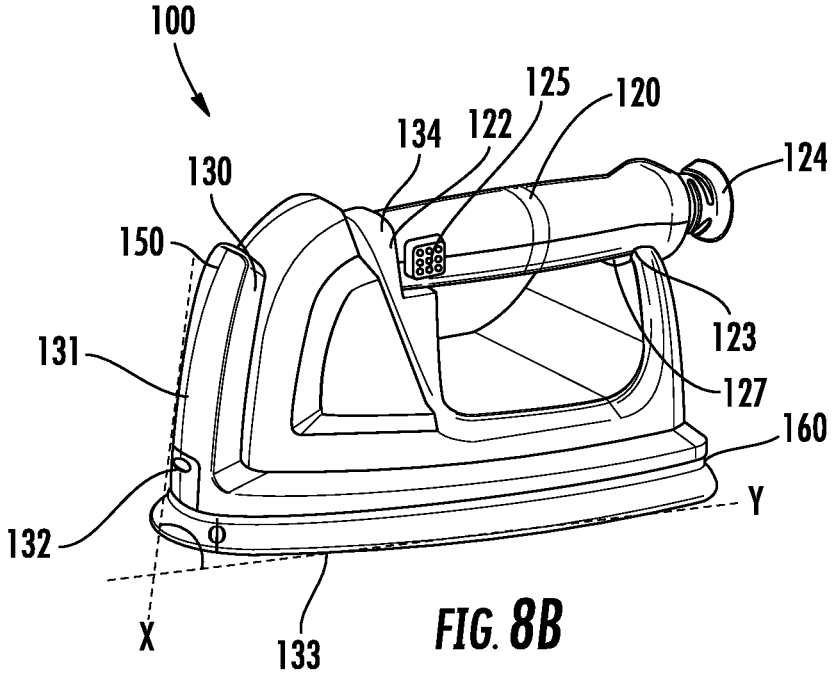

FIGS. 8A-8B show a steam accessory system 100 according to one embodiment according to the present disclosure. As shown in FIG. 8A, the steam accessory system 100 includes an apparatus 120 having a body 120. Near a first end 123 of the body 120 is an inlet 124, while an outlet 122 may be located about a second end 126 of the body 120. In this embodiment, the first end 123 is opposite the second end 126. In one embodiment, the steam accessory system 100 further includes a device 130 or a head 130 having an inlet (head inlet) or opening 134 and a recess 127. The device 130 may be configured to receive the apparatus 120, where the first end 123 of the body 120 is received on the recess 127 while the outlet 122 of the apparatus 120 may be received in the inlet or opening 134 of the device 130, as best illustrated in FIG. 8B. In operation, steam from the inlet 124 of the apparatus 120 may be discharged through the outlet 122 of the body 120 and into the inlet or opening 134 of the device 130.

In operation, the apparatus 120 may be similar to a steam pistol, which may dock onto the device 130 similar to an accessory that may be used for ironing clothing or cleaning surfaces. Once the apparatus 120 is docked or received on and into the device 130 the apparatus 120 may form a handle for the unit or system 100. The apparatus 120, formerly a steam pistol, may provide a user with enhanced ergonomics and also the ability to apply considerable downward force on the device 130. In one instance, the apparatus 120 or steam pistol may be used by itself without the device 130 or iron accessory. In another instance, the apparatus 120 or steam pistol may be used in conjunction with the device 130 or iron accessory. One of the objectives of the steam accessory system 100 is to provide consumers with above-floor steam cleaning accessory for tackling stains and surface cleaning.

In one embodiment, the apparatus 120 further includes a button 125 disposed about the second end 126 for decoupling the apparatus 120 from the device 130. This button 125 may be a latching mechanism so as to allow an extension to be retracted from the inlet or opening 134 of the device 130 and thus removal of the apparatus 120 from the device 130. In another embodiment, there may be another button 125 about the second end 126 for controlling the discharge of steam from the inlet 124 through the outlet 122. In other words, this button 125 may function like an on/off button for controlling a valve within the body of the apparatus 120 such that the flow of steam within the body of the apparatus 120 may be manually controlled by a user.

In one embodiment, the device 130 further includes a first outlet or vent 132 and a second outlet or vent 138. The first vent 132 may be disposed about a first axis 131 while the second vent 138 may be disposed about a second axis 133. The second outlet or vent 138 is at the bottom of the device 130 and will be shown in more detail in subsequent figures. Furthermore, the first axis 131 and the second axis 133 are not parallel as may be seen by the dashed lines X and Y. This will be elaborated in more detail in subsequent figures and discussion.

In operation, the first and second vents 132, 138 are in fluid communication with the inlet or opening 134 of the device 130 such that the first vent 132 is operable to discharge steam during a first mode of operation, while the second vent 138 is operable to discharge steam during a second mode of operation, the first and second modes being different modes of operation.

As shown, the first axis 131 is substantially along the X while the second axis 133 is substantially along the Y. The X and the Y are able to intersect at an angle (Φ). In one embodiment, the angle (Φ) of intersection may be an acute angle. In another embodiment, the angle (Φ) of intersection may be a right angle, e.g., X and Y may be perpendicular to each other. In yet another embodiment, the angle (Φ) of intersection may be an obtuse angle. It will be appreciated by one skilled in the art that X and Y are not parallel and may never be parallel.

In one embodiment, the first outlet or vent 132 is able to discharge steam out the front of the device 130. In another embodiment, the second outlet or vent 138 is able to discharge steam out the bottom of the device 130. In one mode of operation, the inlet 124 of the apparatus 120 and the first outlet or vent 132 are able to transmit steam along a substantially forward direction, e.g., toward and out the front of the steam accessory system 100. In another mode of operation, the inlet 124 of the apparatus 120 and the second outlet or vent 138 are substantially perpendicular to each other. In other words, the inlet 124 of the apparatus is able to discharge steam out the front the apparatus 120 while the second outlet or vent 138 discharges steam out the bottom of the apparatus 120.

FIGS. 9A-9D show the steam accessory system 100 in one mode of operation. In one embodiment, the device 130 further includes a mechanism 130 disposed within, wherein the mechanism 140 may be configured to be actuated between the first mode of operation and the second mode of operation. In another embodiment, the device 130 further includes a member 136 in communication with the mechanism 140. In a first mode of operation, the mechanism 140 is capable of preventing fluid communication between the opening or inlet 134 and the second outlet or vent 138. In a second mode of operation, actuation of the member 136 may cause the mechanism 140 to be actuated so as to prevent fluid communication between the opening or inlet 134 and the first outlet or vent 132.

Figure 9A:
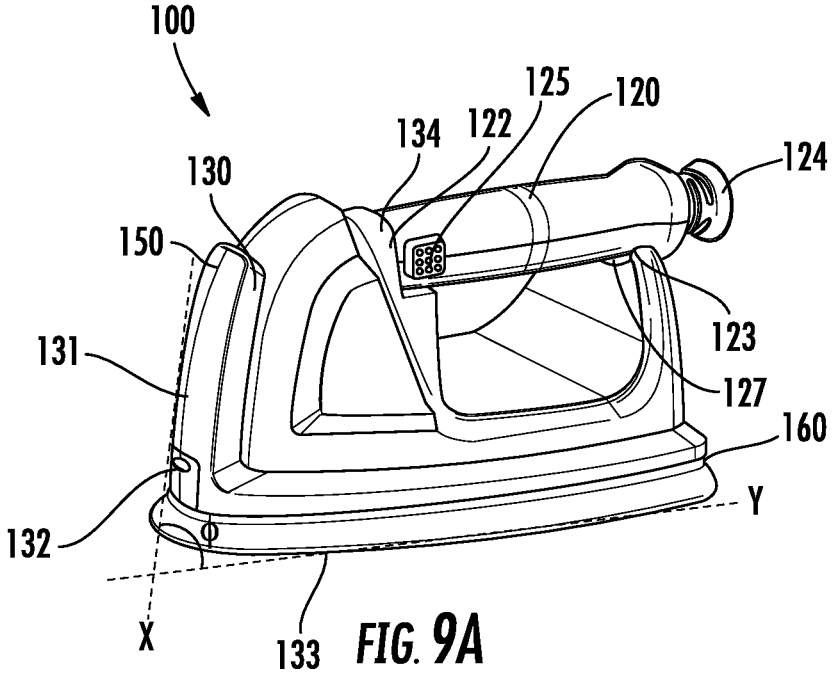
FIGS. 9A-9D show the steam accessory system in one mode of operation.
Figure 9B:
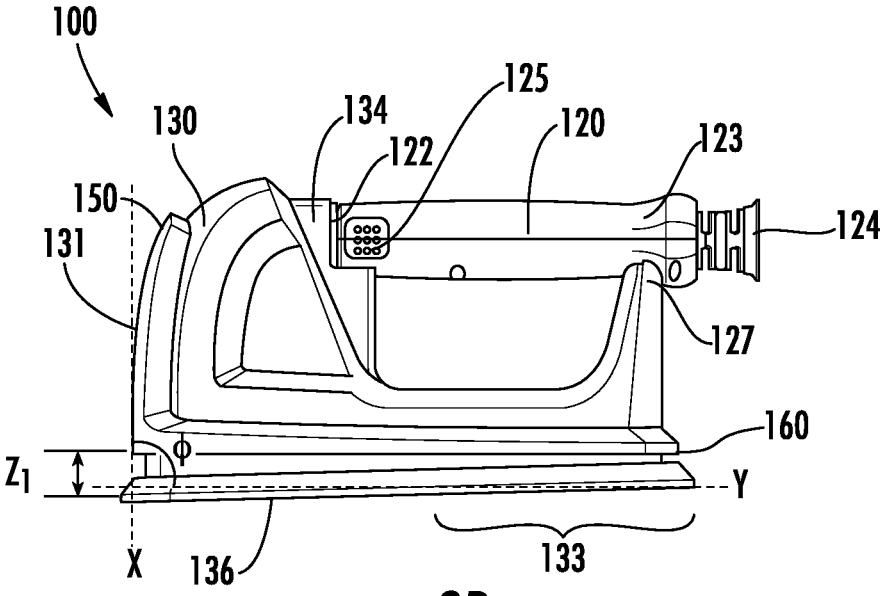

As shown in FIGS. 9A-9B, the steam accessory system 100 is substantially similar to that shown in FIGS. 8A-8B. In this embodiment, the system 100 includes a device 130 having an inlet 134 configured to receive steam from the apparatus 120, and first and second outlets 132, 138 in fluid communication with the inlet 134. The first outlet 132 is configured to discharge steam in a first mode of operation.

The first outlet 132 is defined through a first portion of the device 130. The first portion 150 of device 130 further defines a first axis 131. The second outlet 138 is configured to discharge steam in a second mode of operation. The second outlet 138 is defined through a second portion of the device 130. The second portion 160 of the device 130 further defines a second axis 133. When the first and second axes 131 and 133 intersect at a first angle (A1), steam is discharged in the first mode of operation. Similarly, when the first and second axes 131 and 133 intersect at a second angle (A2), steam is discharged in the first mode of operation. In one embodiment, the first axis 131 and the second axis 133 are not parallel. Similarly, the first mode and second mode are different modes of operation. The first and second angles A1 and A2 are right angles or different acute or obtuse angles.

Similar to above, in some embodiments, the first axis X and the second axis Y may intersect at an angle (Φ), where the angle (Φ) is an acute angle in one example. The angle (Φ) may be a first angle A1 or a second angle A2. In other examples, the angle (Φ) may be a right angle or an obtuse angle. As shown in the FIGS. 9A through 9D, the angle (Φ) is an acute angle although it may be appreciated by one skilled in the art that the outlets 132, 138 may be designed such that the axes X, Y cross at right or obtuse angles.

In one example, the first outlet 132 is able to discharge steam out the front of the device 130. In another example, the second outlet 138 is able to discharge steam out the bottom of the device 130. In some instances, the inlet 134 of the device 130 and the first outlet 132 may be along substantially similar, forward direction. In other instances, the inlet 134 of the device and the second outlet 138 are substantially perpendicular to each other.

Similar to above, the steam accessory system 100 also includes an apparatus 120 having a body 120 and inlet 124 about one end 123 and an outlet 122 about an opposite end 126. The apparatus 120 may be received on a recess 127 of the device 130, and the outlet 122 of the apparatus 120 along with an end 126 of the body 120 may be received within the inlet or opening 134 of the device. Various buttons 125 similar to those discussed above may be incorporated on the apparatus 120.

Figure 9C:
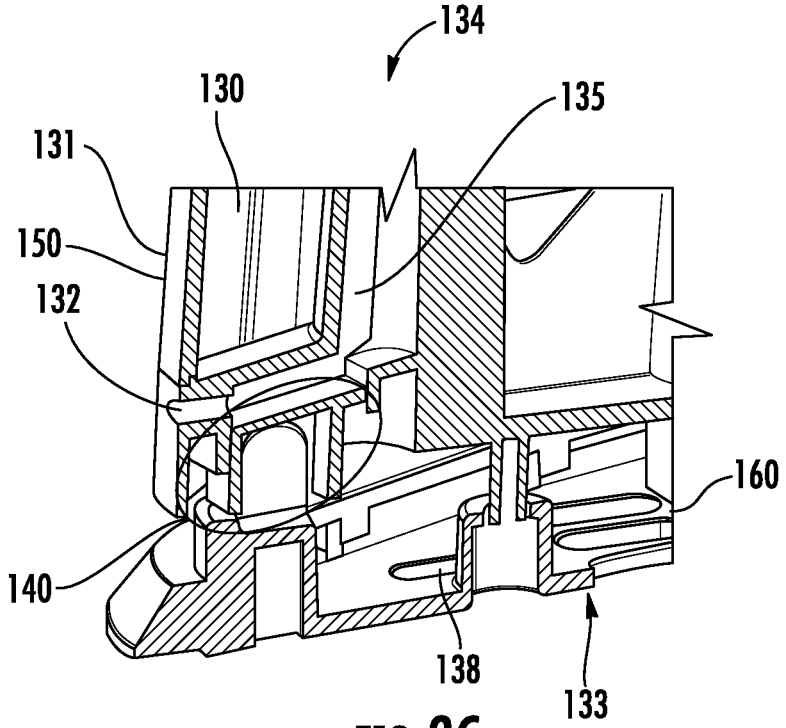
Figure 9D:
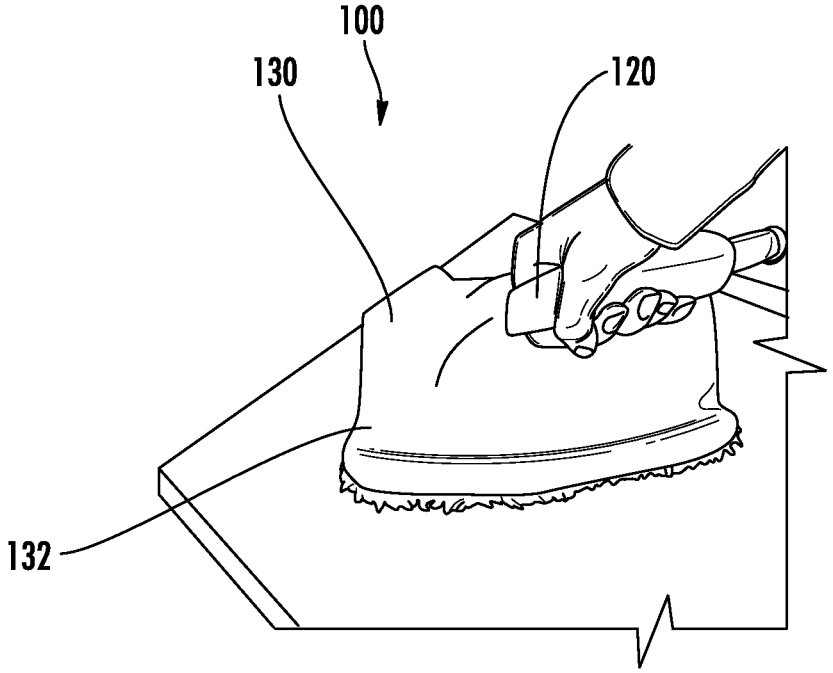

FIGS. 9C-9D show the internals of the system 100 and the device 130 in operation. In one embodiment, the device 130 further includes a mechanism 140 configured to be actuated between the first mode of operation and the second mode of operation. In this embodiment, the device 130 further includes a member 136 in communication with the mechanism 140 such that in the first mode of operation, the mechanism 140 prevents fluid communication between the inlet 134 and the second outlet 138. In the second mode of operation, actuation of the member 136 causes the mechanism 140 to be actuated thereby preventing fluid communication between the inlet 34 and the first outlet 132. It will be appreciated by one skilled in the art that although only one outlet 132, 138 is shown, there may be a plurality of outlets 132, 138, whether first outlets 132 along the first axis 131 or second outlets 138 along the second axis 133.

In one example, the mechanism 140 may be a changeover valve. In the inactive mode (e.g., first mode of operation), the mechanism 140 is not triggered or actuated by any external force or component (e.g., no force is being applied to the member 136 thus the mechanism 140 is not actuated), steam entering the inlet 134 may travel through a pathway 135 unobstructed and be discharged out the first outlet 132. In this instance, the mechanism 140 is not actuated or triggered by the member 136 and therefore the mechanism 140 is able to obstruct the fluid pathway or communication between the inlet 134 and the second outlet 138. In this example, the member 136 may be an actuable plate at the bottom of the device 130. In the instance of an iron, the member 136 may be a cleaning surface plate that when pressed on a surface, will in turn actuate the mechanism 140. The lack of actuation of the member 136 may be seen by the spacing $Z_1$, which is greater in distance compared to the spacing $Z_2$ (best shown in FIG. 9B). This will be discussed in more detail in subsequent figures and discussion.

FIG. 9D shows the actual device in the first mode of operation whereby the mechanism 40 is not actuated and therefore fluid communication is able to take place between the inlet 134 and the first outlet 132 via the fluidic pathway 135. In this case, one may see the user holding the pistol 120 in the form of a handle, and utilizing it in conjunction with the iron accessory 130. Steam is being visibly discharged from the first nozzle 132. Also shown is a hose attached to the inlet 124 of the pistol 120. It will be appreciated by one skilled in the art that steam may be introduced into the pistol 120 via the inlet 124 by a hose, the steam coming from a steam generator similar to systems described in US Pat. App. No. 2011/0073140 published Mar. 31, 2011 and entitled "Steam Appliance," which is hereby incorporated by reference in its entirety for all purposes. This steam introduced into the pistol 20 may subsequently travel from the inlet 124 to the outlet 122, and then into the inlet or opening 134 of the iron accessory for discharge via the outlets 132, 138.

In one mode of operation, the steam accessory system 100 is held away from a cleaning surface. In other words, the system 100 does not make or come into physical contact with a surface to be cleaned. In doing so, nothing is actuating the mechanism 140 and therefore steam is discharged out the front outlet 132 of the device 130. This provides a consumer with a steam blasting feature to aid in the removal of stains whereby a highly concentrated amount of steam may be delivered to a desired surface or area to be cleaned. Furthermore, in this instance, the mechanism 140 (e.g., changeover valve) is blocking the pathway between the inlet 134 of the device 130 and the second bottom outlet 138, and thus allowing steam to be directed out the front of the unit 130 creating the blasting effect. In other words, the changeover valve is able to block the steam from entering the main steam chamber (e.g., bottom of the iron accessory).

Figure 10A:
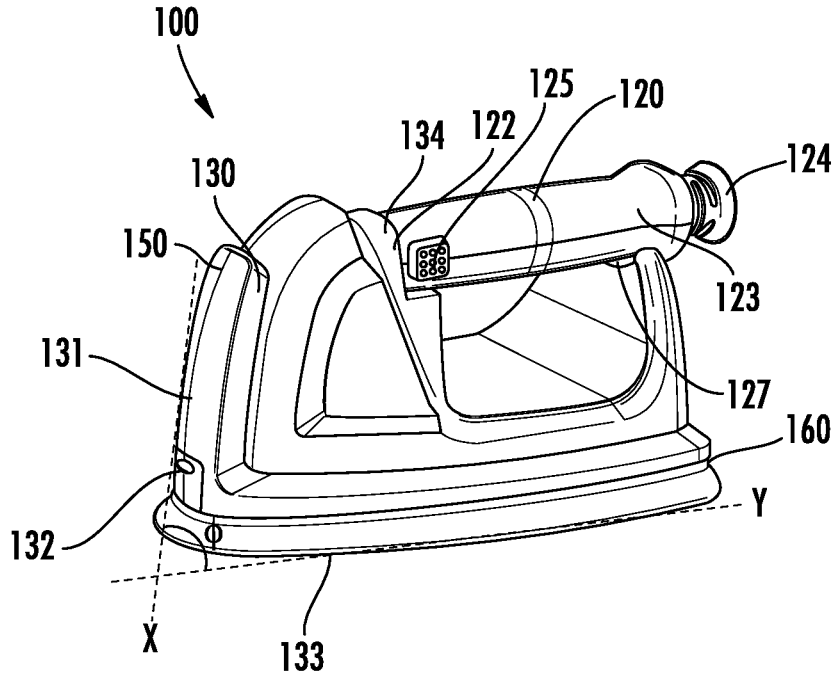
FIGS. 10A-10D show the steam accessory system in another mode of operation.
Figure 10B:
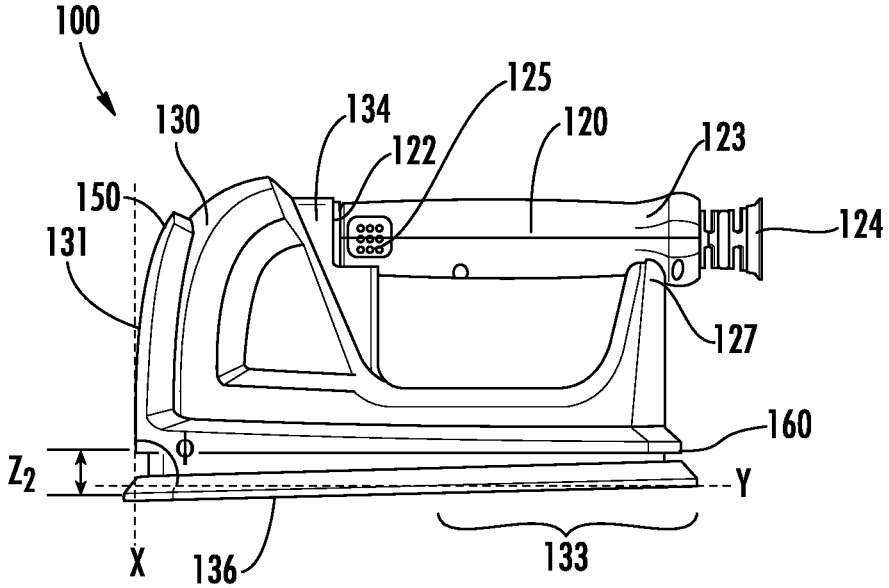
Figure 10C:
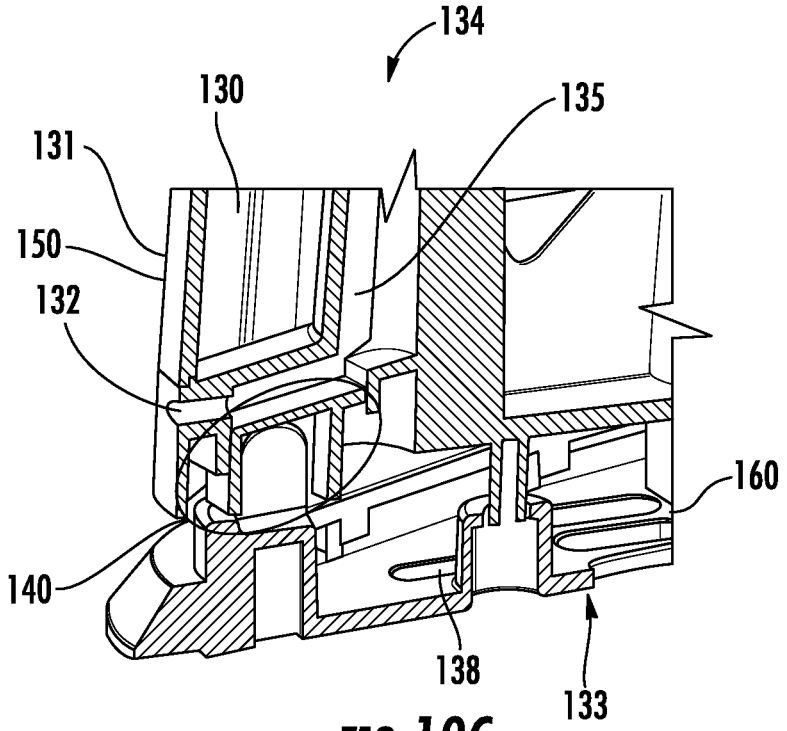
Figure 10D:
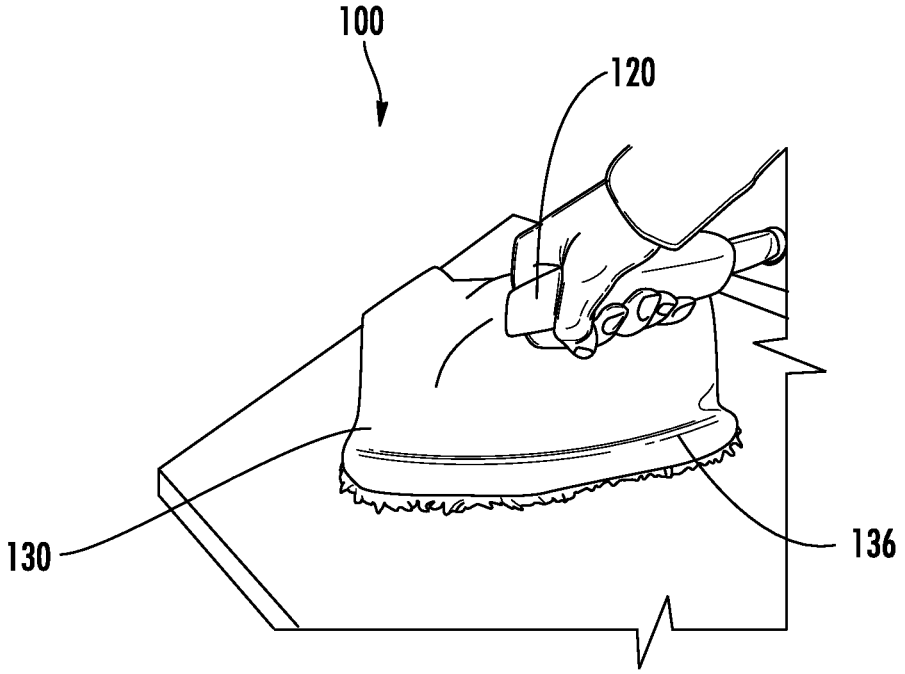

FIGS. 10A-10D show the internals of the system 100 and the device 130 in a second mode of operation. This embodiment is substantially similar to that of FIGS. 9A-9D with the exception that the mechanism 140 or changeover valve has been actuated by the member 136 or bottom plate or pad. This is best illustrated by comparing FIG. 9B and FIG. 10B showing the member 136 being actuated and the spacing ($Z_2$) of the member 136 near the bottom of the device 130 being much smaller in magnitude than the spacing ($Z_1$) of the member 36 near the bottom of the device 130. The actuation is the result of pressing the unit 100 on a cleaning surface during this second mode of operation, the resulting actuation of the member 136 causes the mechanism 140 to prevent fluid communication between the inlet 134 and the first outlet 132. This may be best shown in the internal schematics in FIG. 10C, where the steam from the inlet 134 in this example has been directed downward and out of the second outlet 138 as shown by the arrow. By having the member 136 plate make contact with a surface to be cleaned, the member 136 causes actuation of the mechanism 140, which is actuated and in turn blocks the fluid communication between the inlet 134 and the first outlet 132.

In operation, actuation of the member 136 may be carried out by applying a downward force on the body of the apparatus 120. In other words, a user holding the pistol 120 like a handle as that substantially shown in FIG. 10D, may simply apply a downward force thereby contacting the member 136 to a surface to be cleaned. Doing so would cause the member 136 to actuate the mechanism 140 thereby allowing steam to be discharged out the second outlets 138 in the second mode of operation. In some instances, actuation of the member 136 may be carried out by a button 125 similar to those discussed earlier on the second end 126 of the pistol 120. The button 125 may function as a mechanical switch for actuating the mechanism 140. Inactivation of the button 125 would allow the system 100 to be used in a first mode of operation (e.g., steam blast mode, steam out the front) while activation of the button 125 would allow the system 100 to be used in a second mode of operation (e.g., steam iron mode, steam out the bottom), the two modes of operation being different.

In some embodiments, steam from the second outlet 138 may be directed to a main steam chamber and subsequently onto a pad as best shown in FIG. 3D. The pad may subsequently be used for cleaning the surface. In one embodiment, when the unit 100 is pressed on a cleaning surface, steam is directed downward into the steam chamber heating the attached pad. This is made possible due to actuation of the changeover valve blocking steam from exiting out the front of the unit and thereby directing the steam internally into the main steam chamber.

Different attachments for a steam cleaning device may alter the internal steam temperatures and back pressure. And a single steam rate may not deliver optimum steam performance at different internal temperatures and back pressure. This may lead to intermittent or sputtering steam delivery. An embodiment of the devices disclosed herein may address this problem by automatically detecting the type of attachments coupled to the steam cleaning device and adjusting the steam rate accordingly.

Figure 11:
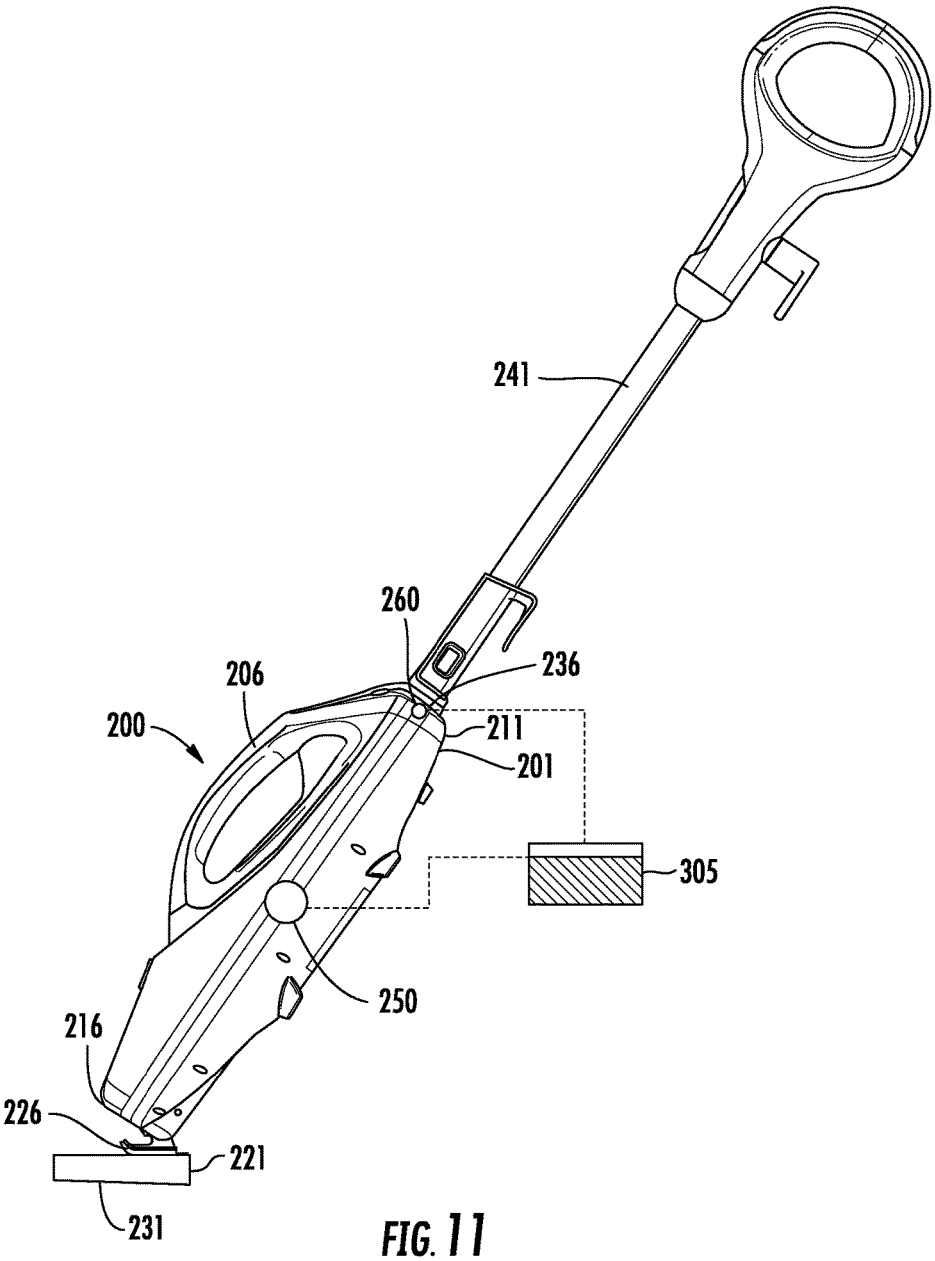
FIG. 11 is a schematic diagram illustrating an exemplary embodiment of a multipurpose steam cleaning device.

In one embodiment, as illustrated in FIG. 11, a steam cleaning device 200 has a body 201 configured to be connected to a steam-generating unit 250. In some embodiments the body 201 may be configured to house the steam-generating unit 250. As may be appreciated, various types of steam-generating units 250 may be used. In alternative embodiments, the steam-generating unit 250 may be positioned at different locations inside the body 201.

In some embodiments, the body 201 may include a shoulder strap (not shown) so that it may be easily transported. But, as may be appreciated, a shoulder strap may be positioned at various other locations on the steam cleaning device 200. In other embodiments, the body 201 may include a handle 206. And, in still other embodiments, the body 201 may include a handle 206 and a shoulder strap.

The body 201 may also be configured to house a water reservoir (not shown). In alternative embodiments, the water reservoir may be positioned at different locations throughout the body 201. In some embodiments, the water reservoir and the steam-generating unit 250 may be incorporated into one element. The body 201 may also include an inlet 211 for receiving water to fill the water reservoir. As may be appreciated, different types of inlets may be used. And, in other embodiments, the inlet 211 may be positioned at different locations.

The body 201 may comprise a first end 236 and a second end 216. In some embodiments, a steam outlet (not shown) for discharging steam produced by the steam-generating unit 250 may be disposed at the second end. In some embodiments, a first attachment 221 may be removably attached to the body at the second end 216. The first attachment may have a steam inlet 226 that may be coupled with the second end 216 of the body 201. The first attachment 221 may also have a steam-discharge outlet 231 wherein steam is delivered to the surface that is being treated. In an embodiment, this first attachment 221 may include a mop head or pocket mop head or any type of cleaning head designed for cleaning or treating surfaces. In some embodiments, the first attachment may be any device designed for floor treatments or any other area treatments. In some embodiments, the first attachment 221 may be designed to be used while the steam application device is upright or oriented at an angle relative to the body 201. But, as may be appreciated, various other types of first attachments 221 may be used in alternative embodiments. In still other embodiments, the second end 216 may be configured to connect to a plurality of first attachments 221 that are interchangeable wherein each first attachment 221 is designed for a different cleaning or treatment purpose.

In some embodiments, the second end 216 may also be configured to receive a second attachment (not shown). In some embodiments, the second attachment may comprise a steam inlet that may be coupled with the second end 216 of the body 201. The second attachment may further comprise a steam-discharge outlet. The second attachment may take the form of a hose. In a different embodiment, the second attachment may comprise an agitation device or scrubber member as may be illustrated in FIGS. 1-6. The scrubber member may comprise a scrubbing pad, brush or any device for scrubbing. In some embodiments, the second attachment may be designed for above-floor treatment. In some embodiments, the second attachment may be designed for any type of area cleaning or treatment. However, as may be appreciated, a variety of second attachments may be utilized in alternative embodiments. In other embodiments, the second end 216 of the body 201 may be configured to connect to a plurality of second attachments that are interchangeable wherein each second attachment is designed to be used for a different cleaning or treatment purpose.

In some embodiments, the first end 236 of the body 201 may be configured to receive an extension 241. The extension 241 may be removably attached to the first end 236. In an embodiment, the extension 241 may be a pole such as pole 16 illustrated in FIG. 1. In other embodiment, the extension 241 may be a combination of a pole and handle such as pole 16 and a handle 18 illustrated in FIG. 1. In yet another embodiment, the extension 241 may take the form any structure employed for handling or maneuvering the steam cleaning device 200. The extension may give the user leverage to move the steam cleaning device 200 as desired when a first attachment 221 or a second attachment is attached to the body 201. In an embodiment, the extension 241 may be removed from the first end 236 when it is not in use. In another embodiment, the extension 241 may be removed when a second attachment is attached to the body 201. In a different embodiment, when the first attachment 221 or a second attachment is used for a different area cleaning/treating purpose, the extension 241 may be removed. In yet different embodiment, when extension 241 is removed, the handle 206 of the body may be used for maneuvering the device 200. As may be appreciated, the extension 241 may be manufactured with a variety of materials, and it may take a variety of forms in alternative embodiments.

The steam cleaning device 200 may also comprise a sensor 260. In one embodiment, the sensor 260 is configured to detect when the extension 241 is attached to the body and when it is detached. This sensor 260 may take the form a Hall-effect sensor 260. The sensor 260 may be located at the first end. However, as may be appreciated, different types of sensor 260*s* may be used in alternative embodiments. And, in other embodiments, the sensor 260 may be located at different places on the device 200.

In some embodiments, the steam cleaning device 200 also comprises a controller (not shown in FIG. 11) in communication with the sensor 260 and the steam-generating unit 250. The controller may be mechanical, electrical, or electro-mechanical. In an embodiment, the controller may comprise a mechanical switch configured to be triggered by the sensor 260 to actuate, either mechanically or electrically, a corresponding operation of the steam-generating unit 250. In some embodiments, when the extension 241 is attached to the body 201, the controller will actuate the steam-generating unit 250 to supply steam at a first steam mode. The first steam mode being configured to optimize steam production for a first attachment 221 so that it does not cycle and the first attachment 221 delivers a continuous steam flow. In another embodiment, the controller may include an electrical microcontroller configured to receive signals from the sensor 260 and output control signals to the steam-generating unit 250. In another exemplary embodiment, the steam cleaning device 200 may have no controller, and the operations of the steam-generating unit 250 may be triggered directly by the signals from the sensor 260.

In some embodiments, the first steam mode may have at least a first and a second steam rates of the first steam mode. The first steam rate of the first steam mode may correspond to a high setting which results in a relatively high-steam production rate. And the second steam rate of the first steam mode may correspond to a low setting that results in a relatively low-steam production rate. In other embodiments, the first steam mode may only have a first or a second steam rate. In yet other embodiments, the first steam mode may have more than two steam rates. The additional steam rates may correspond to different types of steam cleaning operations.

Figure 12:
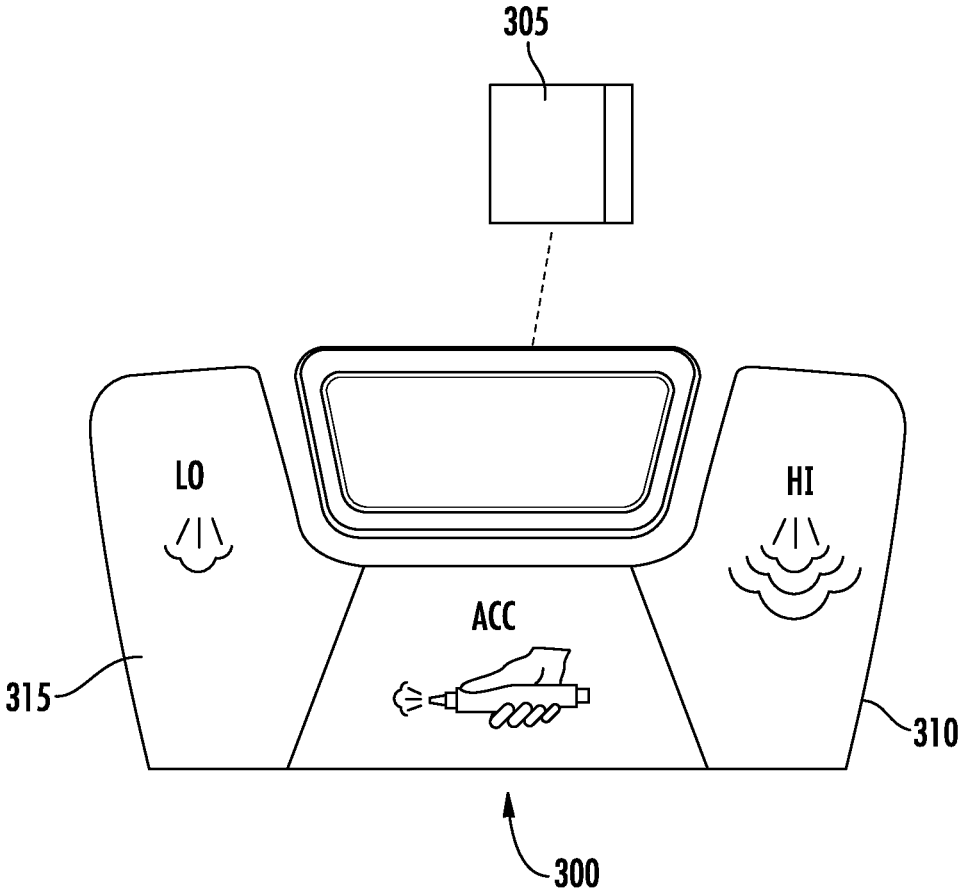
FIG. 12 is a schematic diagram illustrating an embodiment of a user interface.

In an embodiment, the steam cleaning device 200 may also include an optional user interface 300 as depicted in FIG. 12. The user interface 300 may be in communication with the controller 305. The user interface may trigger, mechanically or electrically, the controller 305 to direct the steam-generating unit 250 to produce steam at the high setting when the user selects the high setting 310 when the device is in the first steam mode. And the user interface may signal the controller 305 to direct the steam-generating unit 250 to produce steam at the low steam rate when the user selects the low setting 315. The user may toggle between these settings as desired. This user interface 300 may be a control panel user interface. In other embodiments, other means such as a switch may be employed to give the user the ability to select the high setting 310 or the low setting 315. In some embodiments, the low setting will deliver steam at a rate of about 20 grams per minute. In some embodiments, the high setting will deliver steam at a rate of about 28 grams per minutes. In other embodiments, the high and low settings may be configured to deliver steam at other rates. In other embodiments, the first mode may also have additional settings that correspond to additional steam rates.

In some embodiments, when the extension 241 is not attached to the body, the controller 305 may signal the steam-generating unit 250 to supply steam at a second steam mode. The second steam mode may be configured to produce steam at a first steam rate of the second steam mode. The first steam rate of the second steam mode may be designed to produce an optimal amount of steam for the second attachment so that there is a substantially continuous steam flow. In one embodiment, the first steam rate of the second steam mode may be configured to deliver steam at a rate of about 22 grams per minute, but it may be appreciated that in alternative embodiments, different rates may be employed.

In some embodiments, the second steam mode may only have one steam rate. But, in other embodiments, additional steam rates may be available in the second steam mode. For example, in some embodiments, the second steam mode may have a first and second steam rates of the second steam mode.

In some embodiments, a sensor 260 such as the sensor 260 described above may detect whether a first attachment 221 is attached to the second end 216 or a second attachment is attached to the second end 216 of the body 201. In one embodiment, the sensor 260 may take the form of a pressure sensor 260 that gauges the back pressure to detect whether a first attachment 221 or a second attachment is attached. The pressure sensor 260 may then signal the controller to operate in either the first steam mode or the second steam mode, which in turn may direct the steam-generating unit 250 to produce steam at the appropriate rate. It may be appreciated that other embodiments may employ other types of sensor 260*s* to detect whether a first attachment or a second attachment is attached. One such alternative embodiment is a Hall-effect sensor 260. In another embodiment the device may include a thermostat or temperature sensor 260. As may be appreciated, the sensor 260 may be located at different places on the device 200. In one embodiment, the sensor 260 is located at the second end 216. Further, as may be appreciated, different types of sensor 260*s* may be used in alternative embodiments.

In some embodiments, the same sensor 260 may detect whether an extension 241 is attached to the first end of the body or whether a first attachment or second attachment is attached to the second end of the body. In other embodiments, different sensor 260*s* may be provided to detect whether an extension 241 is attached to the first end of the body or whether a first or second attachment is attached to the second end of the body.

In some embodiments, the steam cleaning device 200 may also include a standby mode. This mode may be triggered each time the extension 241 is attached or detached from the first end 236 of the body 201. In other embodiments, this mode may be triggered by other means such as a button or a switch. The steam flow will halt when in standby mode. The standby mode may allow the user to switch out a first attachment with a second attachment or vice versa. The flow of steam may then be restarted in the appropriate mode when desired by the user. In some embodiments, the user may restart the steam production when in first steam mode by selecting either the high setting 310 or the low setting 315, which will then signal the controller 305 to direct the steam-generating unit 250 to resume production. In some embodiments, the user may restart the steam production when in second steam mode by selecting the ACC setting 320, which will then signal the controller 305 to direct the steam-generating unit 250 to resume production. Other embodiments may employ other means to restart steam production.

In another embodiment, a standby mode may be triggered when the first attachment or second attachment is removed from the second end 216 of the body 201. The sensor 260 will signal the controller when the first attachment or second attachment is removed. And the controller will direct the steam-generating unit 250. Like discussed above, the standby mode will halt the flow of steam until the user restarts it. Also, like discussed above, there are a variety of ways that steam production may be restarted after the device has entered standby mode.

Additional embodiments may also have additional modes. The additional modes may correspond to additional attachments. Or, the additional modes may correspond to different types of cleaning operations. The additional steam modes may also have the same steam rates discussed above or additional steam rates. In some embodiments, the steam cleaning device 100 may be configured so that some or all of the additional steam rates are available only when the steam cleaning device 200 is in a steam cleaning mode that corresponds to that steam rate.

In some embodiments, the steam cleaning device 200 does not have a controller. In one such embodiment, the steam cleaning device 200 may be configured to automatically adjust the steam rate depending on which attachments is attached to the second end 216 of the body 201. Or, in some embodiments, the steam cleaning device 200 may adjust the steam rate depending on whether an extension 241 is attached or not to the first end 236 of the body 201.

As may be appreciated, the steam cleaning device 200 may be powered by various means. In one embodiment, it is powered by a rechargeable battery. In another embodiment, the steam cleaning device may have a plug that may be directly connect to a wall outlet.

Although the disclosure has been described in detail with reference to several embodiments, additional variations and modifications exist within the scope and spirit of the disclosure as described and defined in the following claims.

What is claimed is:

1. An apparatus comprising:

a body comprising:

a steam generator unit configured to produce steam; a controller in electrical communication with the steam generator unit;

a first end, and a second end defining a body outlet configured to output steam generated by the steam produced by the steam generator unit;

an extension attached to the first end of the body, the extension comprising a handle portion and a shaft extending between the handle portion and the first end of the body; and a head removably attached to the second end of the body, wherein the head comprises a head inlet in fluid communication with the body outlet and configured to direct steam from the body outlet through the head to a target surface to be contacted by a first surface of the head for cleaning;

wherein the body comprises a scrubber member connected to the second end of the body;

wherein attachment of the head to the second end of the body prevents the scrubber member from reaching the cleaning surface;

wherein detachment of the head from the second end of the body permits the scrubber member from reaching the cleaning surface; and wherein the controller is configured to operate the steam generator unit in a first mode to produce steam at a first rate that is different from a second steam rate in a second mode.

2. The apparatus of claim 1, wherein the head comprises a plurality of openings configured to output steam to the cleaning surface.

3. The apparatus of claim 1, wherein the scrubber member is pivotable relative to the second end of the body.

4. An apparatus comprising:

a body comprising:

a body outlet configured to output steam;

a scrubber member configured to be oriented in a retracted state or in a deployed state; and an actuation mechanism configured to deploy or retract the scrubber member; and a head removably coupled to the body, wherein the head comprises:

a head inlet in fluid communication with the body outlet; and a head outlet in fluid communication with the head inlet;

wherein when the head is coupled to the body, the scrubber member is in a retracted state, the head inlet is configured to receive steam, and the head outlet is configured to output steam outside of the apparatus; and wherein when the head is removed from the body, steam is output outside of the apparatus from the body outlet, and the scrubber member is configured to be in a deployed state by an actuation of the actuation mechanism.

5. The apparatus of claim 4, wherein when the scrubber member is in the deployed state, the scrubber member extends away from the body and when the scrubber member is in retracted state, the scrubber member moves towards the body.

6. The apparatus of claim 5, wherein a distance the actuation mechanism actuates is substantially similar to a distance the scrubber member extends away from the body.

7. The apparatus of claim 4, wherein the actuation mechanism and the scrubber member are substantially co-axial relative to each other.

8. An apparatus comprising:

a steam generating unit configured to produce steam;

a body comprising a first end and a second end, the second end comprising a steam outlet outputting steam, an extension removably attached to the first end of the body, the extension comprising a handle and a shaft extending between the first end of the body and the handle;

an attachment removably attached to the second end of the body, wherein the attachment comprises a steam inlet in fluid communication with the steam out of the body to receive steam; and a controller configured to operate the steam generating unit in a first or second steam modes; wherein:

when the extension is attached to the body, the controller is configured to operate the steam generating unit in the first steam mode to produce steam at a first steam rate of the first steam mode; and when the extension is detached from the body, the controller is configured to operate the steam generating unit in the second steam mode to produce steam at a first steam rate of the second steam mode, the first steam rate of the first steam mode and the first steam rate of the second steam mode are different.

9. The apparatus of claim 8, further comprising a sensor configured to detect whether the extension is attached to the body and communicate with the controller.

10. The apparatus of claim 9, wherein the sensor comprises a Hall effect sensor, and the extension comprises a trigger detectable by the Hall effect sensor.

11. The apparatus of claim 8, wherein when the extension is attached to the body, the controller is further configured to operate the steam generating unit in the first steam mode to produce steam at a second steam rate, the first and second steam rates of the first steam mode being different from each other and from the first steam rate of the second steam mode.

12. The apparatus of claim 11, wherein the first and second steam rates of the first steam mode correspond to a high setting and a low setting, respectively.

13. The apparatus of claim 12, further comprising a control-panel user interface in communication with the controller and configured to toggle between the high setting and the low setting.

14. The apparatus of claim 12, wherein the first steam rate of the first steam mode in the high setting yields a steam delivery rate of about 28 grams per minute, and wherein the second steam rate of the first steam mode in the low setting yields a steam delivery rate of about 20 grams per minute.

15. The apparatus of claim 12, wherein the first steam rate of the second steam mode yields a steam delivery rate of about 22 grams per minute.

16. The apparatus of claim 8, wherein the controller is configured to operate in:

a standby mode that is triggered when the extension is attached or detached from the first end of the body;

wherein the standby mode, the controller is configured to be triggered by a signal from an user interface of the apparatus to start steam production in the first steam mode if the extension is attached to the first end of the body, and start steam production in the second steam mode if the extension is detached from the first end of the body.

17. An apparatus comprising:

a body comprising:

a first end; and a second end;

a steam generating unit connected to the body;

a first attachment operable to be removably coupled to the second end and comprising a steam outlet;

a second attachment operable to be removably coupled to the second end and comprising a steam outlet;

a controller configured to operate the steam generating unit in a first and second steam modes; wherein:

in the first steam mode, the controller is configured to operate the steam generating unit to produce steam at a first rates whereby a substantially continuous steam flow is delivered through the steam outlet of the first attachment;

in the second steam mode, the controller is configured to produce steam at a second rate whereby a substantially continuous steam flow is delivered through the steam outlet of the second attachment, the second rate being different from the first rates.

18. The apparatus of claim 17, further comprising:

a sensor operable to detect whether the first or second attachment is removably coupled to the second end of the body;

wherein the controller is in communication with the sensor and is configured to direct the steam generating unit to produce steam in the first steam mode if the first attachment is removably coupled and to direct the steam generating unit to produce steam in the second steam mode if the second attachment is removably coupled.

19. The apparatus of claim 18, wherein the sensor comprises a Hall effect sensor.

20. The apparatus of claim 18, wherein the first attachment comprises a mop.

21. The apparatus of claim 18, wherein the first attachment comprises a pocket mop.

22. The apparatus of claim 18, wherein the second attachment comprises a hose.

23. The apparatus of claim 17, wherein in the first steam mode, the controller is further configured to operate the steam generating unit to produce steam at a second rate of the first steam mode, wherein the first and second rates of the first steam mode correspond to a high setting and a low setting, respectively.

24. The apparatus of claim 23, further comprising a control-panel user interface in communication with the controller and operable to toggle between the high setting and the low setting.

25. The apparatus of claim 23, wherein the first rate in the high setting yields a steam delivery rate of about 28 grams per minute, and wherein the second rate in the low setting yields a steam delivery rate about 20 grams per minute.

26. The apparatus of claim 23, wherein the third rate in the second steam mode yields a steam delivery rate of about 22 grams per minute.

27. The apparatus of claim 23, wherein the controller is configured to operate in:

a standby mode that is triggered each time the first or second attachment is coupled or de-coupled from the second end;

wherein in the standby mode, the controller is configured to be triggered by a signal from an user interface of the apparatus to start steam production in the first steam mode if the first attachment is coupled to the second end, and start steam production in the second steam mode if the second attachment is coupled from the second end.

28. The apparatus of claim 17, further comprising:

an extension operable to be removably attached to the first end of the body;

a sensor operable to detect whether the extension is removably attached to the first end of the body;

wherein the controller is in electronic communication with the sensor and is configured to direct the steam generator to produce steam in the first steam mode if the extension is attached and directs the steam generator to produce steam in the second steam mode if the extension is not attached.

29. The apparatus of claim 28, wherein the controller is configured to operate in:

a standby mode that is triggered when the extension is to or detached from the second end;

wherein the standby mode, the controller is configured to be triggered by a signal from an user interface of the apparatus to start steam production in the first steam mode if the extension is attached to the first end, and start steam production in the second steam mode if the extension is detached from the first end.

* * * * *